United States Patent [19]

Mecozzi et al.

[11] 4,412,582

[45] Nov. 1, 1983

[54] BAFFLE ARRAY FOR HEAT EXCHANGE APPARATUS

[75] Inventors: Walter P. Mecozzi; Gary C. Mager, both of North Tonawanda; Stephen A. Maliszewski, Lockport, all of N.Y.

[73] Assignee: Hiross, Inc., Niagara Falls, N.Y.

[21] Appl. No.: 280,850

[22] Filed: Jul. 6, 1981

[51] Int. Cl.[3] ..... F28F 7/00

[52] U.S. Cl. ..... 165/76; 165/159; 165/162

[58] Field of Search ..... 165/162, 76, 159–161

[56] References Cited

U.S. PATENT DOCUMENTS 2,496,301 2/1950 Meixl ..... 165/134

2,581,121 1/1952 McCurdy et al. ..... 165/162

*Primary Examiner*—William R. Cline

*Assistant Examiner*—Theophil W. Streule, Jr.

*Attorney, Agent, or Firm*—Raymond F. Kramer

[57] ABSTRACT

A baffle array or assembly comprised of a plurality of longitudinal spacer rods and baffle plates is described. The spacer rods have a body portion and a protruded portion along their length. The protruded portion has a plurality of slots therein at spaced intervals. The baffle plates have peripheral openings therein adapted to receive the body portion of the spacer rods. The baffle plates and spacer rods are assembled into an array by positioning the baffle plates at right angles to the spacer rods, passing the spacer rods through the peripheral openings in the baffle plates and engaging the thicknesses of the baffle plates within the slots in the protruded portions of the spacer rods.

7 Claims, 3 Drawing Figures

BAFFLE ARRAY FOR HEAT EXCHANGE APPARATUS

BACKGROUND OF THE INVENTION AND PRIOR ART

The present invention relates to baffles utilized in heat exchange apparatus and, more particularly, to baffle arrays useful inside tubes or shells of heat exchange apparatuses to agitate or disrupt the laminar flows of fluid therethrough.

Heat transfer in heat exchange apparatuses occurs through shell walls separating non-mixing fluids. The rate of heat transfer is materially increased by causing one of the fluids to flow in a turbulent manner along the wall, causing a greater mass of the fluid to come into contact with the wall. To create this phenomenon, it has been common practice to place baffles within the shell to intercept and deflect the concentric fluid flow layers through the shell in order to bring a greater number of molecules of the flowing fluid into contact with the exterior of the tube walls. Examples of internal baffle arrangements are shown in U.S. Pat. Nos. 2,826,220; 2,852,042; and 3,572,391.

Typically, a baffle array is comprised of an assembly of baffle pieces, spacers and tie-rods. The array is subsequently positioned within a heat exchange shell. The assembly of such an array is time-consuming and if intermittent or non-regular baffle spacing is desired a number of varying sized spacers must be utilized.

The present invention provides a baffle array for heat exchange apparatuses which obviates the time-consuming assembly and provides a means of quickly and accurately spacing baffle members within an array.

Although the present invention is particularly suited to use in industrial air cooling units, wherein the fluid flowing within the shell is water, it will be understood that the present baffle arrangement is equally suited to use in any heat exchange process wherein the heat exchange unit contains baffles. It will also be understood that the term "fluid" as used herein includes both liquids and gases.

SUMMARY OF THE INVENTION

The present invention relates to a baffle array, or assembly, which is comprised of a plurality of longitudinal spacer rods and baffle plates. The spacer rods each have a body portion and a protruded portion along their lengths. The protruded portion has a plurality of slots therein at spaced intervals. The baffle plates have peripheral openings therein adapted to receive the body portion of the spacer rods. The baffle plates and spacer rods are assembled into an array by positioning the baffle plates at right angles to the spacer rods, passing the spacer rods through the peripheral openings in the baffle plates and engaging the thicknesses of the baffle plates within the slots in the protruded portions of the spacer rods.

After assembly, the array is fitted within the shell or tube of a heat exchanger. The periphery of the baffle plates closely follows the internal contour of the heat exchanger shell and fits sufficiently snugly within the shell so that the elongated protruded portions of the spacer rods cannot turn to disengage the spacer rods from the baffle plates. Thus, the spacer rods are fixed into the baffle plates and, after insertion into the heat exchanger shell, are not removable from the baffle plates. The spaced slots in the protruded portion of the spacer rods provide a quick, accurate and efficient means of positioning and spacing baffles in an array and, after insertion into a heat exchange shell, hold the baffle plates in a fixed position.

Generally, an array contains between two and about 100 baffle plates and, more usually, between about ten and about fifty. Typically, air cooling heat exchange units contain from about twenty to about forty baffle plates. The spacing between baffle plates is accurately maintained within the present array without the use of tie-rods by the spaced arrangement of the slots in the spacer rods. The present interlocking connection of the baffle plate and spacer rod allows for substantial thermal expansion within the baffle array when in operation, facilitating the use of a wider variety or combinations of materials in the fabrication of the components.

The spacer rods and baffle plates are fabricated of materials which are structurally stable and inert or inactive in the medium in which they are used. Suitable materials are metals, such as stainless steel, plastics, such as polyvinyl chloride or polypropylene, reinforced plastics, fiber glass or laminates of metals and plastics, or combinations thereof.

The present spacer rods perform the functions of tie-rods, and may initially be fabricated with a plurality of regularly spaced slots therein. In use the desired baffle plate spacing may simply be obtained by engaging the baffle plates in only those slots which provide the desired spacing.

The baffle plate snugly fits within the shell of the heat exchange unit. The baffle plate may be solid or perforated. Typically, baffles are measured by the baffle cut. The baffle cut is the percent of the cross-sectional area of the heat exchange shell which is not restricted. Thus, a baffle cut of 0 percent would restrict all flow. A baffle cut of 30 percent would provide unrestricted passage in 30 percent of the cross-sectional area within the shell. The present baffle plates generally have baffle cuts of up to 50 percent preferably between about 5 and about 30 percent.

DETAILED DESCRIPTION OF THE DRAWINGS AND PREFERRED EMBODIMENTS

Figure 1:
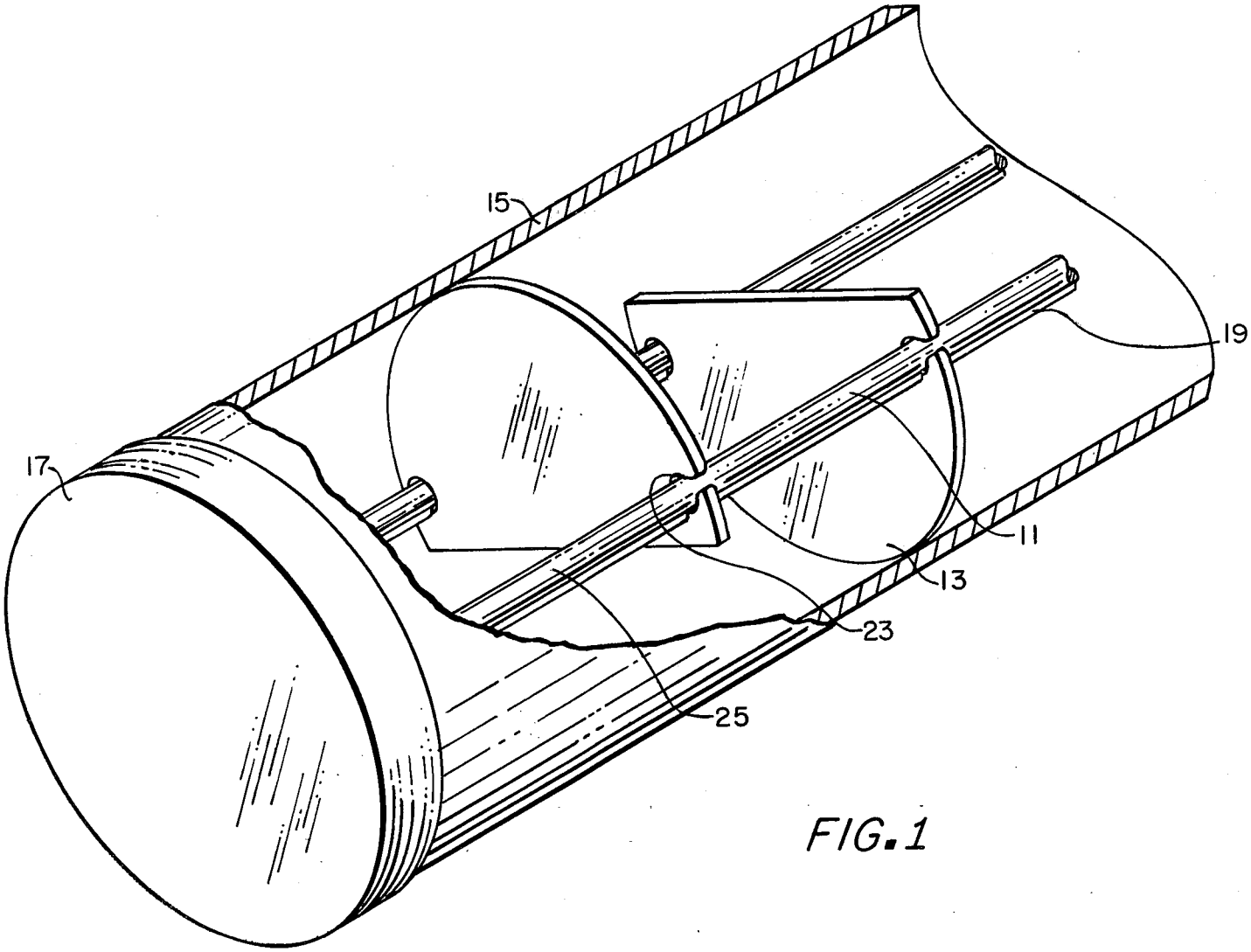
FIG. 1 is a partially cut away perspective view showing the present baffle array positioned within the shell of a heat exchange unit.

Looking now at FIG. 1, a baffle array comprised of elongated spacer rods 11 engaged with baffle plates 13 is positioned within the shell 15 of a heat exchanger apparatus. As shown, shell 15 has a cap member 17 and is suitably connected to an inlet and outlet, not shown, adapted to allow fluid flow internally through the length of shell 15.

Spacer rods 11 have a protruded portion 19 along the length thereof. Preferably, the protruded portion extends outward from the body portion of spacer rods 11 a distance of at least about ¼ of the diameter of the body portion. Although shown with a pair of spacer rods, which generally is the most useful mode, additional spacer rods may be included in the array to further stabilize the array. The protruded portion 19 of spacer rods 11 has a plurality of slots 21 therein positioned to receive and hold baffle plates 13 in accurate spaced relation with each other. Baffle plates 13 have openings 23 therein adapted to receive body portions 25 of spacer rods 11. The widths of baffle plates 13 are engageable within slots 21. When placed within the shell 15, with slots 21 engaging plates 13, as illustrated, the protruded portions 19 are fixed therein and cannot turn to become disengaged from baffle plates 13, thereby providing an array of secured, accurately spaced baffle plates within the heat exchange shell. Such engagements of slots 21 and plates 13 are made by rotating rods 11, which are initially positioned by insertions of the rods through the openings 23 with protrusions 19 facing outwardly, until the plates and slots match as desired.

Although shell 15 may have various cross-sectional shapes, circular is preferred and most practical. The exterior contours of baffle plates 13 contiguous to the internal surface of shell 15 closely follow the internal contour of shell 15 to yield a snug fit.

Figure 2:
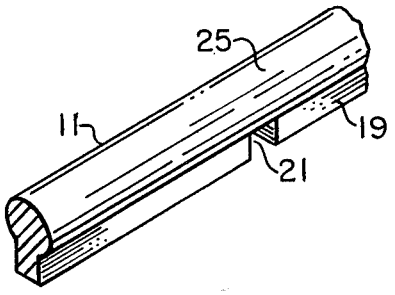
FIG. 2 is a cross-sectional perspective view of a spacer rod, illustrating a preferred shape.

FIG. 2 illustrates a spacer rod 11 of a preferred shape. The body portion 25 is preferably circular or nearly circular in cross-section and the protruded portion 19 is preferably rectangular or square in cross-section. Spacer rod 11 may have a plurality of slotted elongated portions, such as that identified by numeral 19, which may extend further around the rod body than is illustrated. However, the purpose of the slotted elongated portion is to facilitate keying or locking by turning the spacer rod within the openings in the baffle plates, and a single elongated portion, as illustrated, is simplest and is preferred.

Figure 3:
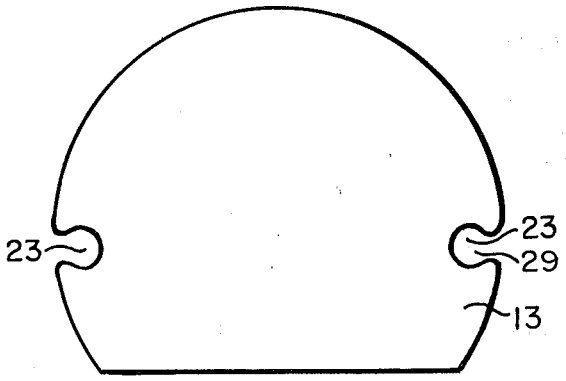
FIG. 3 is an elevational view of a baffle plate, illustrating a typical contour of the openings on the periphery adapted to engage the spacer rods.

FIG. 3 illustrates a baffle plate 13 having openings 23 of a preferred circular or near circular shape, corresponding approximately to the cross-sectional shape of spacer bars 11. Openings 23 extend through the edges of baffle plate 13 to receive spacer rods 11. Although openings 23 may be shaped other than circular, a circular or near circular shape facilitates easier turning of the spacer rods 11 to engage slots 21 with the widths of baffle plates 13 and is therefore preferred.

The foregoing description and embodiments are intended to illustrate the invention without limiting it. It will be understood that various modifications can be made in the invention without departing from the spirit or scope thereof.

What is claimed is:

1. An internal baffle array for a heat exchange unit comprising a plurality of longitudinal spacer rods, each having a body portion and a protruded portion along the length thereof, said protruded portions having a plurality of slots therein at spaced intervals, and a plurality of baffle plates positioned at right angles to said spacer rods, said baffle plates each having a plurality of openings at the periphery thereof adapted to receive at least the body portions of said rods, with said spacer rods passing through the openings in said baffle plates and holding the baffle plates in desired spacing relationship by engagement of the widths of said plates within said spaced slots in said protruded portions of said rods upon rotations of the rods.

2. A baffle array according to claim 1 which is positioned within a heat exchanger shell, against the interior walls of which the baffles fit.

3. A baffle array according to claim 1 which contains between two and about one hundred baffle plates.

4. A baffle array according to claim 1 wherein the baffle plates have baffle cuts of up to 50 percent.

5. A baffle array according to claim 1 wherein the longitudinal spacing rods have body portions which are approximately circular in cross-section and have protruded portions which are approximately square or rectangular in cross-section.

6. A baffle array according to claim 5 wherein the spaced slots are substantially only in the protruded portions of the longitudinal spacing rods and are of a width about the thickness of the baffle plates.

7. A baffle array according to claim 1 wherein the openings in the baffle plates at the peripheries thereof are of a substantially circular shape with an extension from such circular opening at the periphery to accommodate at least a part of the protruded portion of the longitudinal spacer rod to facilitate insertion of such rods through such openings in a plurality of such baffle plates during the assembly of such array.

* * * * *